US005826144A

United States Patent [19]

Takenaka et al.

[11] Patent Number: 5,826,144

[45] Date of Patent: Oct. 20, 1998

[54] DEVELOPING DEVICE FOR AN ELECTROPHOTOGRAPHIC RECORDING APPARATUS INCLUDING BIAS CONTROL OF A TONER SUPPLYING ROLLER

[75] Inventors: Eiji Takenaka, Atsugi; Kazuhiro Yuasa, Zama; Shuichi Endoh, Isehara; Iwao Matsumae, Tokyo; Yoshiaki Tanaka, Kawasaki; Hiroshi Hosokawa, Yokohama; Mugijiroh Uno, Isehara; Hiroshi Saitoh, Ayase; Toshihiro Sugiyama; Tetsuo Yamanaka, both of Tokyo; Eisaku Murakami, Hiratsuka; Satoru Komatsubara, Isehara, all of Japan

[73] Assignee: Ricoh Company, Ltd., Tokyo, Japan

[21] Appl. No.: 638,697

[22] Filed: Apr. 26, 1996

[30] Foreign Application Priority Data

Apr. 28, 1995 [JP] Japan ..... 7-106535
Apr. 19, 1996 [JP] Japan ..... 8-098693

[51] Int. Cl.[6] ..... G03G 15/06; G03G 15/08

[52] U.S. Cl. ..... 399/222; 399/99; 399/235

[58] Field of Search ..... 399/222, 55, 66, 399/234, 235, 99, 226

[56] References Cited

U.S. PATENT DOCUMENTS 5,079,115 1/1992 Takashima et al. ..... 399/226 X
5,486,909 1/1996 Takenaka et al. ..... 399/274
5,489,747 2/1996 Takenaka et al. ..... 399/272

FOREIGN PATENT DOCUMENTS 1-312 568A 12/1989 Japan .
6-175477 6/1994 Japan .
07244423 9/1995 Japan .

OTHER PUBLICATIONS

Patents Abstracts of Japan, P. 1015, 1990, vol. 14, No. 114.

Patents Abstracts of Japan, P–1222, 1991, vol. 15, No. 262.

*Primary Examiner*—Arthur T. Grimley
*Assistant Examiner*—Quana Grainger
*Attorney, Agent, or Firm*—Oblon, Spivak, McClelland, Maier & Neustadt, P.C.

[57] ABSTRACT

In an electrophotographic recording apparatus of the type using a single-ingredient type developer, i.e., toner, a developing device has a developing roller for conveying the toner deposited thereon, and an intermediate roller for conveying the toner transferred theretofrom the developing roller and depositing it on a latent image electrostatically formed on an image carrier to thereby produce a corresponding toner image. During the development of an area of the image carrier other than a latent image area, a bias assigned to the developing roller is switched over to thereby form an electric field different in direction from an electric field assigned to the formation of the toner image between the two rollers. Further, before the rotation of the image carrier is stopped, the bias assigned to the developing roller is again switched in order to form the electric field for the formation of the toner image between the rollers. As a result, a toner layer is formed on the intermediate roller. Subsequently, the rotation of the image carrier is stopped. The device obviates defective images ascribable to the adhesion of the image carrier and intermediate roller while eliminating background contamination and wasteful toner consumption.

7 Claims, 14 Drawing Sheets

DEVELOPING DEVICE FOR AN ELECTROPHOTOGRAPHIC RECORDING APPARATUS INCLUDING BIAS CONTROL OF A TONER SUPPLYING ROLLER

BACKGROUND OF THE INVENTION

The present invention relates to a developing device included in a plain paper copier, plain paper facsimile apparatus, printer or similar electrophotographic recording apparatus.

A developing device included in an electrophotographic recording apparatus may have a construction taught in, e.g., Japanese Patent Laid-Open Publication No. 6-175477. The developing device has a casing storing a single-ingredient type developer, i.e., toner having high electric resistance. First toner conveying means in the form of a roller is disposed in the casing and receives the toner from a toner supply roller. The toner is magnetically deposited on the conveying means. Second toner conveying means implemented as an elastic roller intervenes between the first toner conveying means and a photoconductive drum or image carrier. The toner is electrically transferred from the first conveying means to the second conveying means. Toner particles charged to the polarity opposite to the expected or regular polarity are prevented from being transferred from the first conveying means to the second conveying means. This allows the second conveying means to deposit only the toner of regular polarity on a latent image electrostatically formed on the drum.

However, assume that the toner is collected from the second toner conveying means after a printing operation. Then, the image carrier and second toner conveying means are held in direct contact with each other until the next printing operation. If the recording apparatus is left unused over a long period of time, then the image carrier and second toner conveying means are apt to adhere to each other. The adhesion damages the image carrier and second toner conveying means and thereby renders images defective.

While the development of the latent image is not under way, the absence of the toner on the second conveying means does not matter at all in respect of the image forming process. However, if the toner is present on the second conveying means or similar member contacting the drum, then it is likely to easily deposit on the drum, compared to the case wherein it is absent. As a result, not only the toner is wastefully consumed, but also the resulting image has its background contaminated.

Moreover, the toner existing on the first and second conveying means includes not only particles charged to the expected polarity but also particles charged little or charged to the opposite polarity. Particularly, assume that a doctor blade for regulating the thickness of the toner deposited on the first conveying means while charging the toner by friction wears due to aging. Then, the toner on the first conveying means increases in amount with the result that the ratio of the toner particles other than the particles of expected polarity increases.

In addition, when the toner contains a metallic soap, i.e., lubricant for preventing the toner from adhering to the doctor blade, the toner particles other than the particles of a polarity promoting toner transfer are little used during ordinary image formation. As a result, such undesirable particles sequentially accumulate in the developing device and are apt to adversely affect the other toner particles and to lower the image quality.

SUMMARY OF THE INVENTION

It is therefore an object of the present invention to provide a developing device for an electrophotographic recording apparatus and capable of obviating defective images ascribable to the adhesion of an image carrier and second toner conveying means, while eliminating background contamination and wasteful toner consumption.

It is another object of the present invention to provide a developing device for an electrophotographic recording apparatus and allowing toner particles and additive not suitable for image formation to be collected at the outside of the device.

A developing device for an electrophotographic image recording apparatus of the present invention has a first toner conveying member for conveying a single-component type toner deposited thereon. A second toner conveying member contacts the first toner conveying member and an image carrier for electrostatically forming a latent image thereon. The second toner conveying member conveys the toner transferred theretofrom the first toner conveying member and deposits it on the latent image to thereby produce a corresponding toner image. A controller stops the rotation of the image carrier when a toner layer is positioned at a nip between the image carrier and the second toner conveying member.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
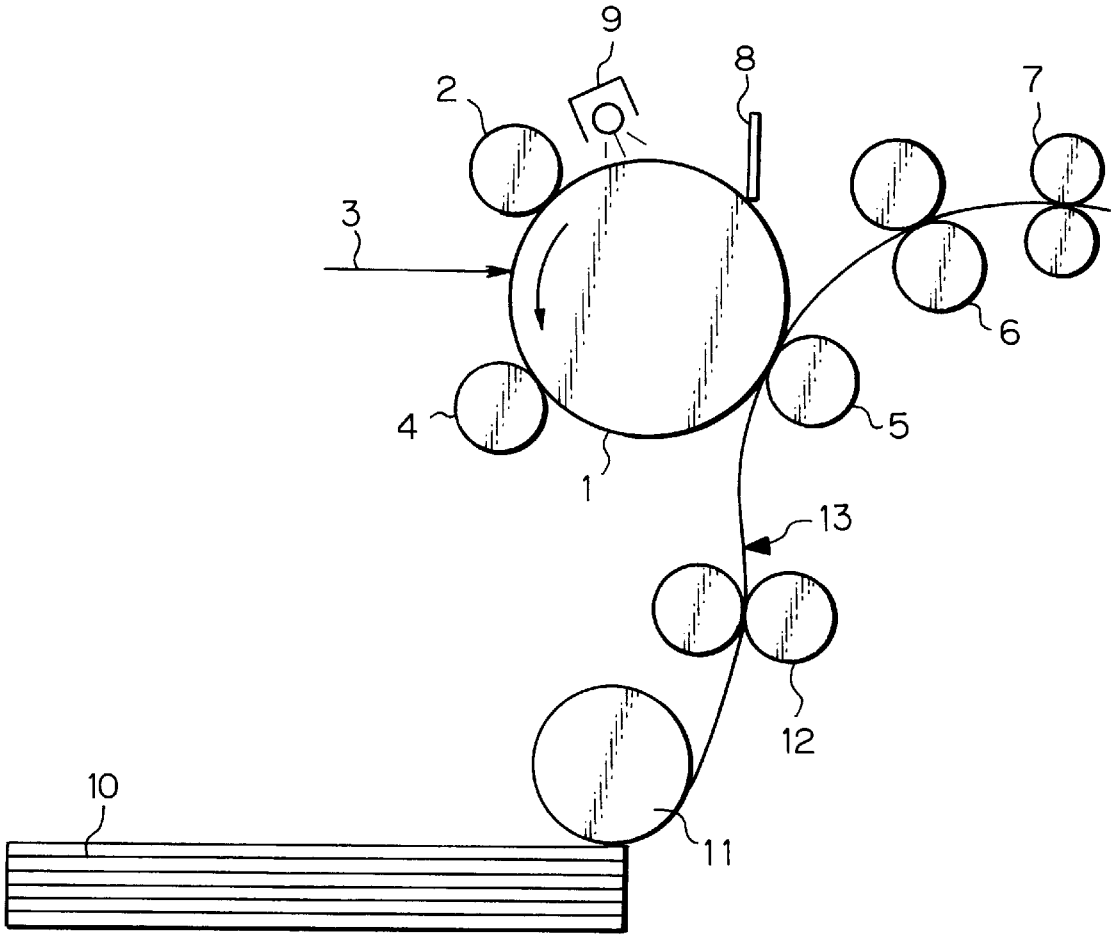
FIG. 1 shows the basic construction of an electrophotographic recording apparatus including a developing device in accordance with the present invention.

Referring to FIG. 1 of the drawings, the basic construction of an electrophotographic recording apparatus in accordance with the present invention is shown. As shown, the apparatus has a photoconductive element, or image carrier, implemented as a drum 1. A charger 2 uniformly charges the surface of the drum 1. An optical writing device represented by an arrow 3 exposes the charged surface of the drum 1 imagewise in order to electrostatically form a latent image thereon. A developing unit 4 selectively deposits a single-ingredient type developer, or toner, on the drum 1 to thereby transform the latent image to a toner image. An image transfer unit 5 is implemented as a roller and transfers the toner image from the drum 1 to a cut sheet 10. A fixing unit 6 fixes the toner image on the sheet 10 by heating it. A discharge roller 7 drives the sheet 10 carrying the fixed toner image out of the apparatus. A cleaning unit 8 removes the toner remaining on the drum 1 after the image transfer. A discharger 9 dissipates the charge also remaining on the drum 1 after the image transfer. The sheet 10 is fed by a pick-up roller 11 to a registration roller 12. The registration roller 12 once stops the sheet 10 and then drives it toward the image transfer unit 5 at a preselected timing. A sheet position sensor 13 is located downstream of the registration roller 12 with respect to the direction in which the sheet 10 is conveyed toward the image transfer unit 5. The sensor 13 is responsive to the leading edge or the trailing edge of the sheet 10.

Figure 2:
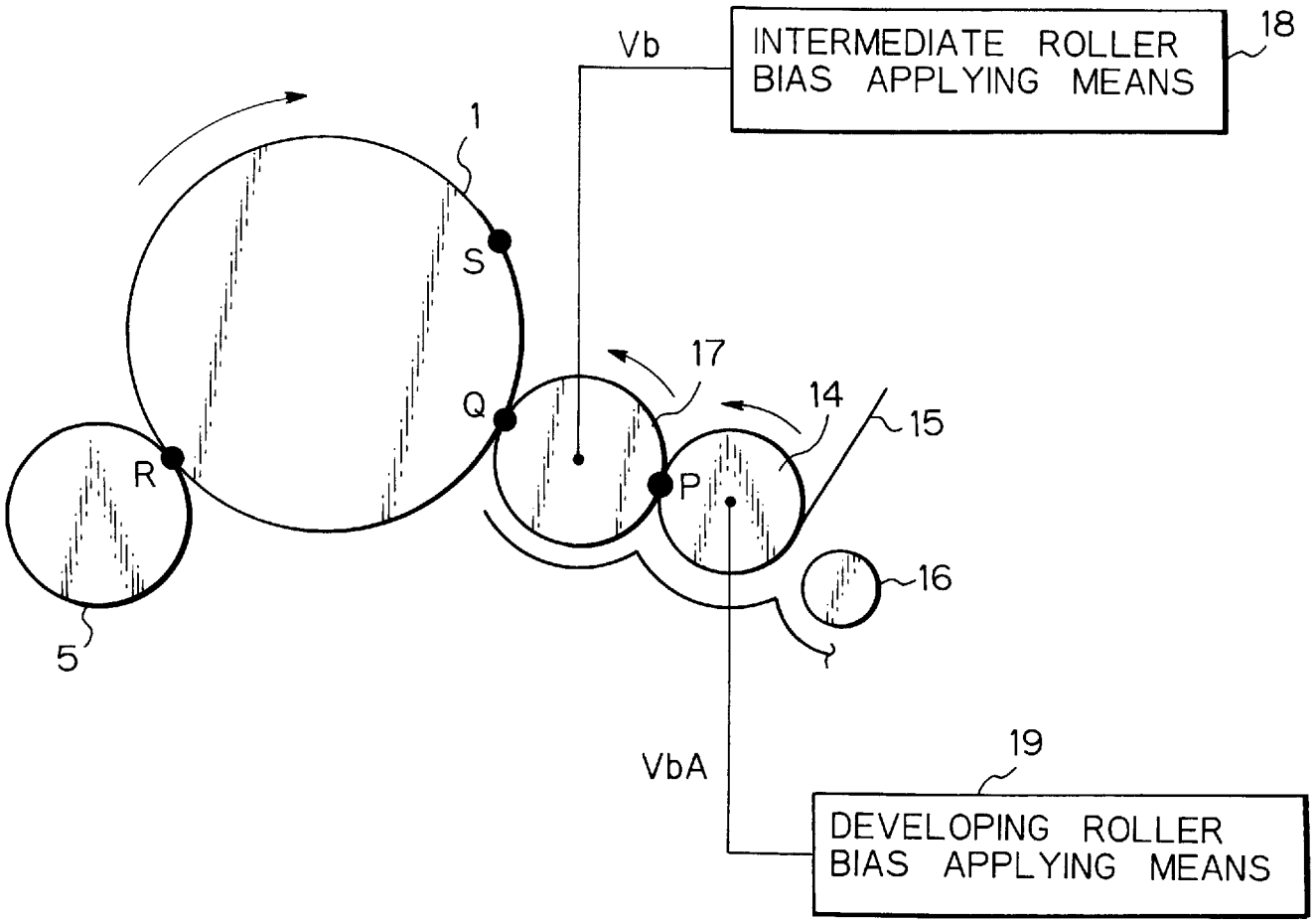
FIG. 2 shows the basic construction of the developing device included in the construction of FIG. 1.

FIG. 2 shows the basic configuration of the developing unit 4. As shown, the developing unit 4 has a developing roller or first toner conveying means 14. The roller 14 is a hard roller magnetized at a preselected pitch. A resilient doctor blade 15 is formed of metal and pressed against the roller 14 under a predetermined pressure in order to regulate the amount of toner to deposit on the roller 14. A toner supply roller 16 supplies the toner to the developing roller 14 while agitating it. An intermediate roller or second toner conveying means 17 is held in contact with each of the developing roller 14 and drum 1 over a predetermined range. The intermediate roller 17 is a soft roller formed of conductive rubber or similar material. Intermediate roller bias applying means 18 applies a bias Vb to the intermediate roller 17. Likewise, developing roller bias applying means 19 applies a bias VbA to the developing roller 14.

In FIG. 2, the optical writing device 3 writes an image on the drum 1 at a position S. The developing roller 14 and intermediate roller 17 contact each other at a position P. The intermediate roller 17 and drum 1 contact each other at a position or nip Q. The image transfer unit or roller 5 and drum 1 contact each other at an image transfer position R.

An electrophotographic process to be executed by the above apparatus will be described with reference to FIG. 1. The drum 1 is rotated counterclockwise, as indicated by an arrow. The charger 2 uniformly charges the surface of the drum 1. While the charged surface of the drum 1 is in movement, the optical writing device 3 exposes it imagewise to thereby electrostatically form a latent image. The developing unit 4 selectively transfers the toner to the latent image formed on the drum 1 so as to produce a corresponding toner image. When the sheet 10 is brought to the image transfer roller 5 via the pick-up roller 11 and registration roller 12, the roller 5 transfers the toner image from the drum 1 to the sheet 10. The sheet 10 with the toner image has the image fixed by the fixing unit 6 and then driven out of the apparatus by the discharge roller 7 as a hard copy. The toner left on the drum 1 after the image transfer is removed by the cleaning unit 8 while the charge left on the drum 1 is dissipated or discharged by the discharger 9. As a result, the surface potential of the drum 1 is restored to 0 V. The above procedure will be repeated when a plurality of hard copies are desired.

Referring again to FIG. 2, the development included in the electrophotographic process will be described specifically. During development, the developing roller 14 and intermediate roller 17 are each rotated counterclockwise, as indicated by an arrow. The drum 1 is rotated clockwise, as also indicated by an arrow. First, the toner supply roller 16 in rotation conveys the toner to beneath the developing roller 14. Because the toner is a single-ingredient type magnetic toner, it is deposited on the surface of the magnetized developing roller 14. The roller 14 conveys the toner toward the intermediate roller 17. At this instant, the doctor blade 15 regulates the toner on the roller 14 to form a thin toner layer while charging it by friction. Assume that the expected or regular polarity of the charge to deposit on the toner is negative by way of example.

The writing unit 3 exposes the surface of the drum 1 having been uniformly charged to about −750 V by the charger 2. As a result, the surface potential of the drum 1 varies to about −100 V in the exposed portion; that is, a potential distribution which is about −100 V in the exposed portion and about −750 V in the unexposed portion or background is set up on the drum 1. The bias Vb applied to the intermediate roller 17 and the bias VbA applied to the developing roller 14 are about −400 V and about −700 V, respectively.

The toner is charged to the negative polarity, and the surface potential of the intermediate roller 17 is higher than that of the developing roller 14, as stated above. As a result, the toner deposited on the roller 14 is transferred to the roller 17 at the position P, forming a toner layer on the roller 17. Although toner particles of positive or irregular polarity may exist on the roller 14, they are not transferred to the roller 17 because the surface potential of the roller 17 is higher than that of the roller 14.

The unexposed or background area of the drum 1 is lower in surface potential than the intermediate roller 17 while the exposed or image area of the drum 1 is higher in surface potential than the roller 17. In this condition, the toner on the roller 17 is transferred only to the latent image on the drum 1, thereby transforming the latent image to a corresponding toner image.

The toner image is transferred from the drum 1 to the sheet 10 and then fixed on the sheet 10, as stated earlier.

Figure 3A:
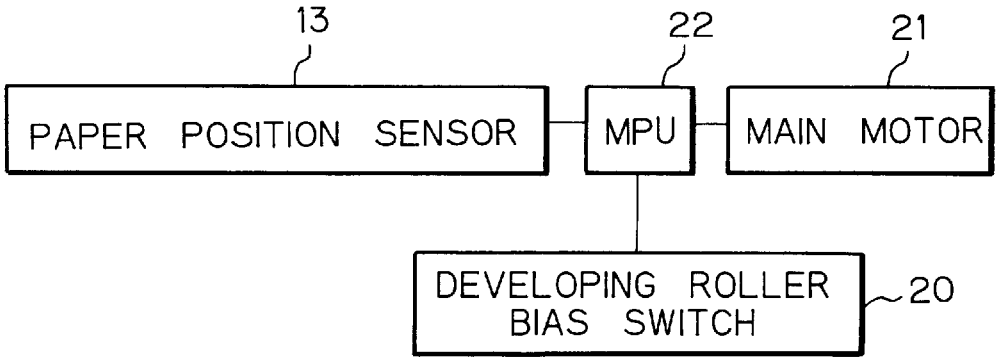
FIGS. 3A and 3B each shows an essential part of a control system included in the apparatus of FIG. 1.
Figure 3B:
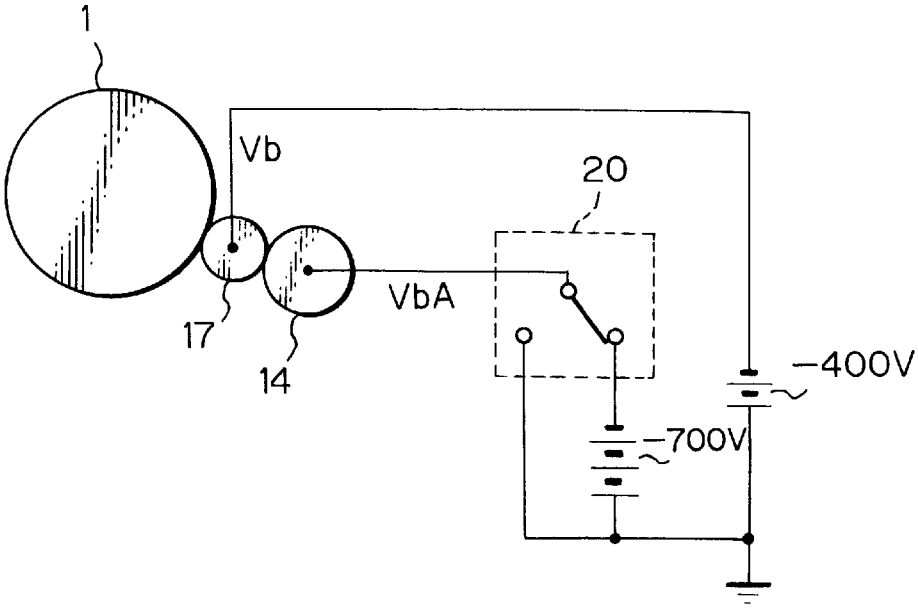

FIGS. 3A and 3B show an essential part of a control system included in the above recording apparatus. As shown, a switch 20 selectively switches the bias VbA assigned to the developing roller 14 to −700 V or 0 V (ground; GND). A main motor 21 is a drive source for driving the drum 1. An MPU (Micro Processor Unit) 22 controls the switch 20. The bias Vb assigned to the intermediate roller 17 is selected to be −400 V.

The operation of the switch 20 is as follows. While the latent image area of the surface of the drum 1 is developed, the bias VbA of −700 V is applied to the developing roller 14. As a result, the toner is transferred from the roller 14 to the intermediate roller 17.

After the above latent image area or sheet area of the drum 1 has been fully developed, the next latent image area of the drum 1 begins to be developed in a predetermined period of time. During the interval between the consecutive developments, the switch 20 switches the bias VbA assigned to the developing roller 14 from −700 V to GND. At this instant, the bias of −400 V is applied to the intermediate roller 17. Hence, during the development of the area other than the latent image areas, the surface potential of the intermediate roller 17 is maintained lower than that of the developing roller 14. Consequently, the toner of negative polarity is transferred from the roller 17 to the roller 14. In addition, because the rollers 14 and 17 move in opposite directions to each other, as seen at the point P, the toner on the roller 17 is removed by a mechanical force and transferred to the roller 14. In this manner, the toner is collected from the roller 17 by the roller 14. When the next sheet area of the drum 1 is to be developed, the bias VbA is switched from GND to −700 V.

After the last latent image has been developed, the bias VbA is switched from −700 V to GND so as to collect the toner from the intermediate roller 17. Then, the bias VbA is again switched to −700 V in order to form a toner layer on the roller 17. In this condition, the main motor 21 is driven for at least a period of time necessary for the point P where the rollers 14 and 17 have contacted at the time of switching of the bias VbA to −700 V to reach the nip Q between the drum 1 and the roller 17. Subsequently the drum 1 is brought to a stop with the toner layer existing at the nip Q.

The toner layer may be formed over the entire periphery of the roller 17. Alternatively, the switching time of the bias VbA assigned to the roller 14 may be controlled such that a toner layer is formed only at the nip Q over a width greater than the width of the nip Q. The crux is that a toner layer be present at the nip Q between the drum 1 and the roller 17.

The toner layer formed between the drum 1 and the roller 17 after printing by the above control prevents the drum 1 and roller 17 from adhering to each other even when the apparatus is left unused over a long period of time. The adhesion would result in defective images.

In the basic construction shown and described, the second toner conveying means may be implemented as a belt, if desired. While the bias VbA assigned to the developing roller 14 is switched to GND in the event of toner collection, it may alternatively be switched to, e.g., −100 V. The crux is that the direction of the electric field between the rollers 14 and 17 during the toner collection be different from the direction during the development. In addition, while the biases VbA and Vb are both switched over in the basic construction, only one of them may be switched over.

Generally, because an electrophotographic recording apparatus transfers a toner image derived from a latent image to a sheet, it may be considered that the latent image area is contained in a sheet area. Assuming that the latent image area is equal to the sheet area, the area of the drum 1 other than the latent image area corresponds to, e.g., the interval between consecutive sheets, the time before the start of printing, or the time after the end of printing.

In a first embodiment of the present invention, the operation of the switch 20 is controlled, as will be described with reference to FIG. 4. The switch 20 may be triggered by the output of the sheet position sensor 13 representative of the leading edge or the trailing edge of the sheet 10. For example, when the output of the sensor 13 representative of the leading edge is used as a trigger, the time for switching the bias VbA is calculated on the basis of the sensor output and the length of the sheet 10. When the output of the sensor 13 representative of the trailing edge is used as a trigger, the above time is calculated beforehand on the basis of the distance between the sensor 13 and the image transfer position. On the elapse of the calculated time after the sensor 13 has sensed the leading edge or the trailing edge of the sheet 10, the MPU 22 causes the switch 20 to switch the bias VbA. If desired, the trigger signal may be implemented by a signal representative of the start of an optical writing operation. Further, a timer may be caused to start counting the time in response to a plotter start trigger signal.

Figure 4:
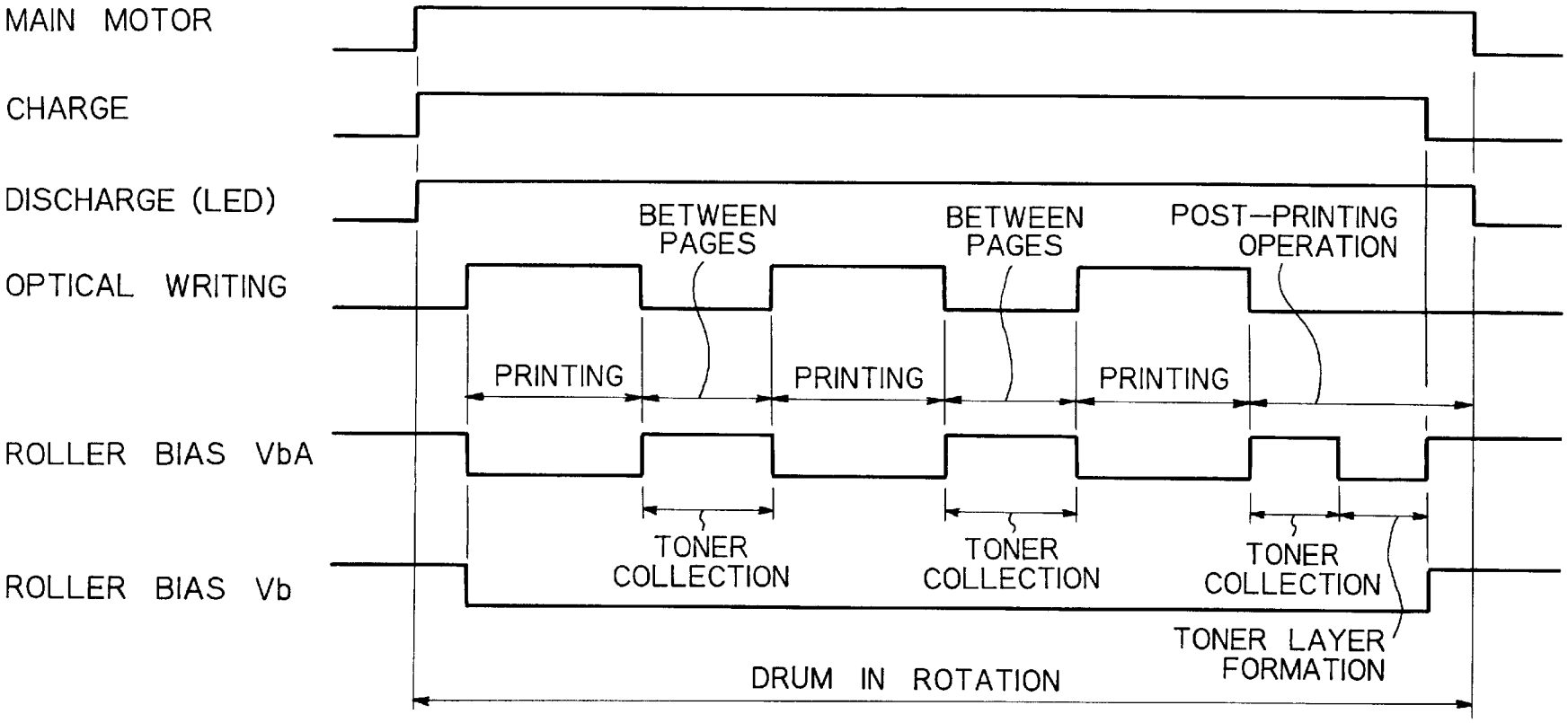
FIG. 4 is a timing chart demonstrating a specific operation of a first embodiment of the present invention.

As shown in FIG. 4, assume that a plurality of sheets 10 are conveyed one after another. Then, while the sheet area of the drum 1 corresponding to the preceding sheet 10 is in development (Printing, FIG. 4), the bias VbA of −700 V is applied to the developing roller 14. In this condition, the toner is transferred from the developing roller 14 to the intermediate roller 17.

During the interval between the end of development of the above sheet area of the drum 1 and the beginning of development of the sheet area corresponding to the next or following sheet 10, i.e., during the development of the area other than the sheet areas, the switch 20 switches the bias VbA from −700 V to GND. At this instant, the bias of −400 V is continuously applied to the intermediate roller 17. Therefore, during the course of development of the area other than the sheet areas, the surface potential of the roller 17 remains lower than that of the roller 14. Consequently, the toner of negative charge is transferred from the roller 17 to the roller 14. In addition, because the rollers 14 and 17 move in opposite directions to each other at the position P, the toner on the roller 17 is removed by a mechanical force and transferred to the roller 14 (Toner Collection, FIG. 4).

When the next sheet area of the drum 1 is to be developed or after the sheet area corresponding to the last sheet 10 has been developed, the bias VbA is switched from −700 V to GND. As a result, the toner on the roller 17 is collected by the roller 14. Subsequently, the bias VbA is again switched from GND to −700 V to cause the toner to form a layer on the roller 17. After the resulting toner layer has been brought to the nip Q between the roller 17 and the drum 1, the drum 1 is caused to stop rotating.

By the above control, a toner layer is formed between the drum 1 and the roller 17 after printing. The toner layer successfully prevents the drum 1 and roller 17 from adhering to each other even when the apparatus is left unused over a long period of time. The adhesion would result in defective images. Further, during the development of the area other other than the sheet areas, the toner is collected from the roller 17 by the roller 14. This obviates background contamination and wasteful toner consumption.

Figure 5:
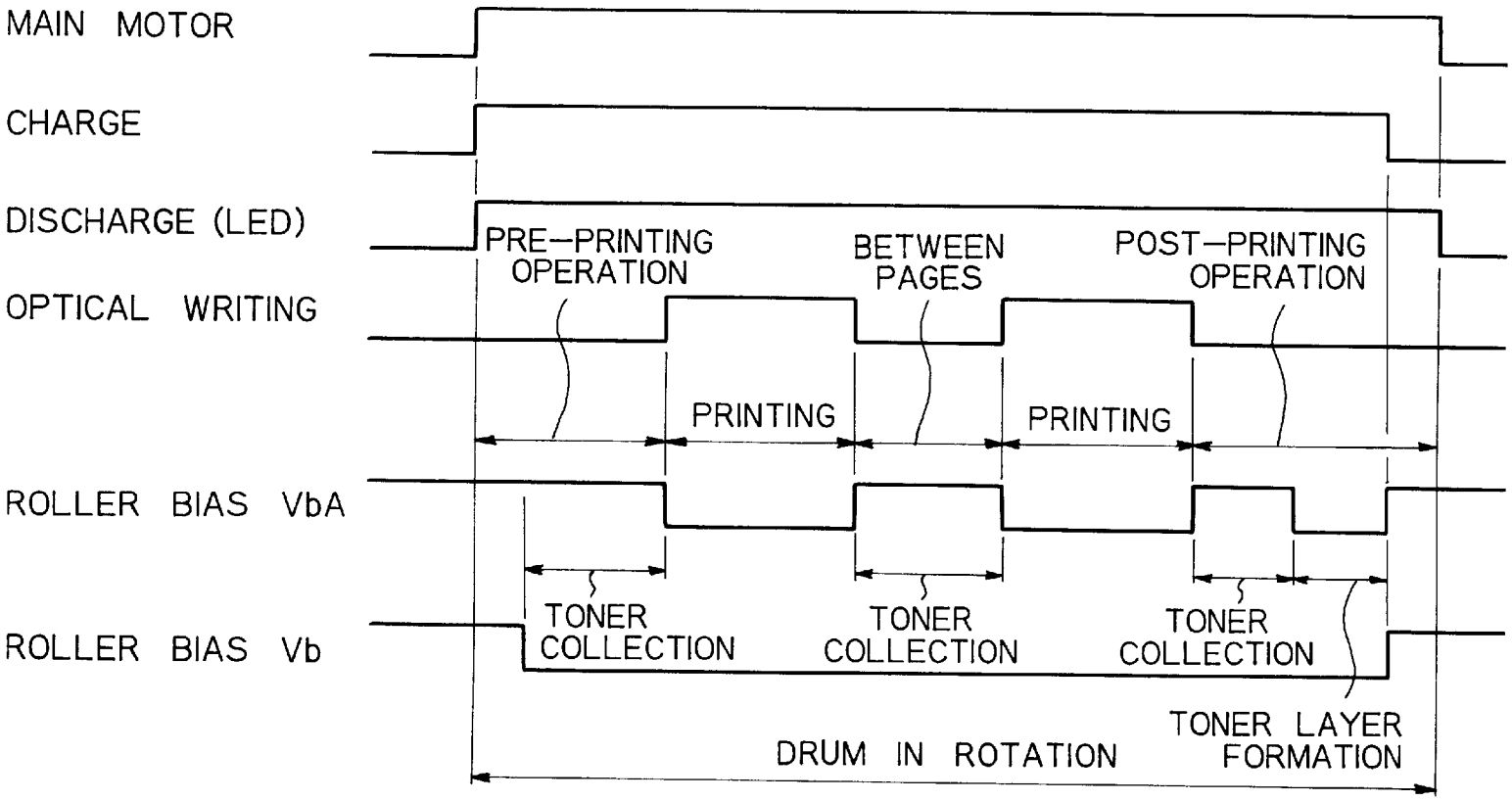
FIG. 5 is a timing chart representative of a specific operation of a second embodiment of the present invention.

FIG. 5 shows a second embodiment of the present invention also pertaining to the control over the switch 20. The rotation of the drum 1 is stopped after the printing operation, as in the first embodiment. In this embodiment, before the next printing operation begins, the bias VbA assigned to the developing roller 14 is switched from −700 V to GND. As a result, the toner is collected from the intermediate roller 17 by the roller 14 due to an electrostatic force acting between the rollers 14 and 17 and a mechanical force.

The above control prevents the toner held on the roller 14 in an unstably charged state from being transferred to the roller 17 at the beginning of a printing operation. This obviates wasteful toner consumption and background contamination, irregular image density and other defects at the beginning of a printing operation.

Figure 6:
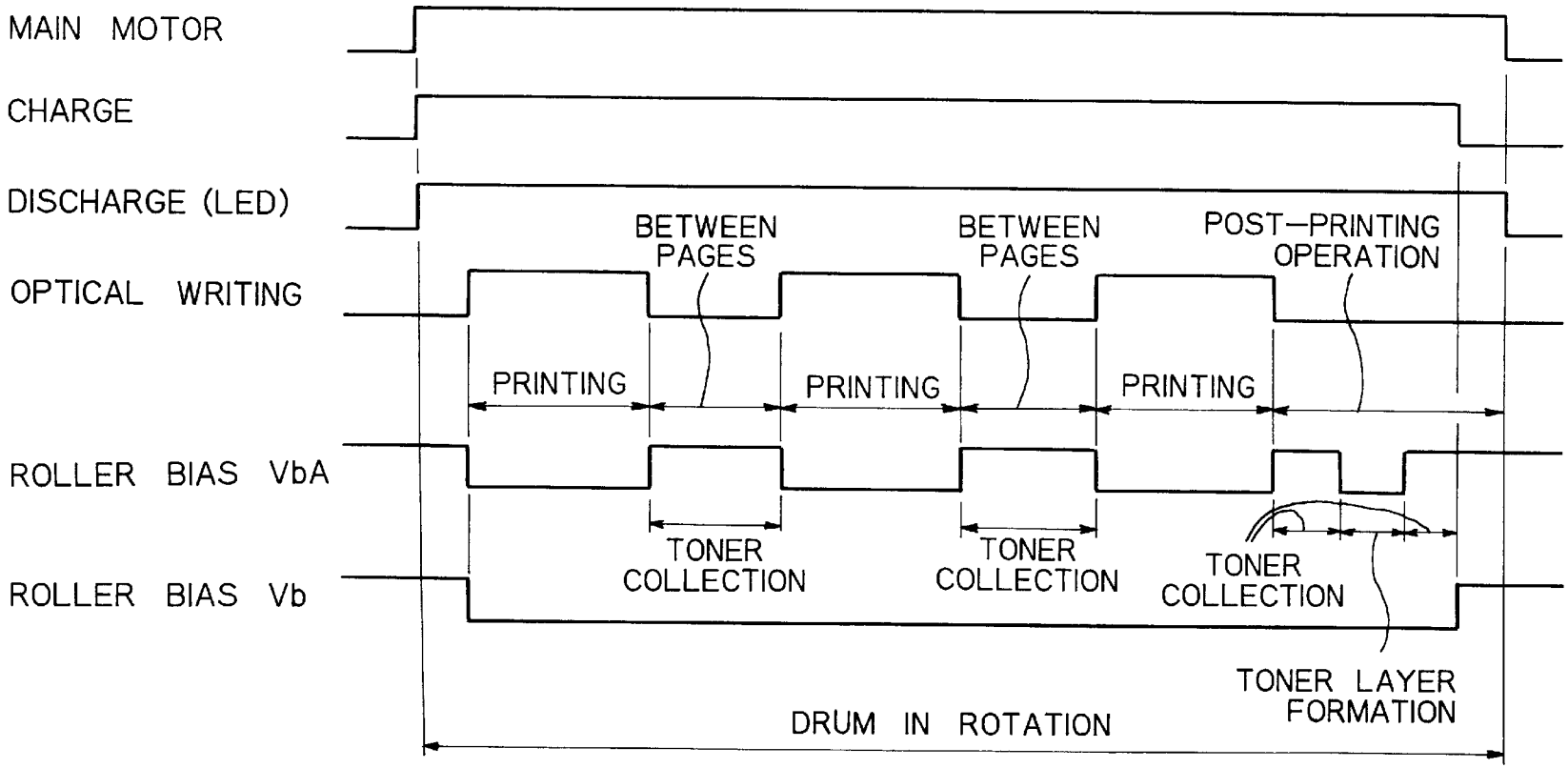
FIG. 6 is a timing chart representative of a specific operation of a third embodiment of the present invention.

FIG. 6 shows a third embodiment of the present invention also pertaining to the control over the switch 20. Assume that the sheet area of the drum 1 corresponding to the last sheet 10 has been fully developed, as in the first embodiment. Then, in this embodiment, the bias VbA is switched from −700 V to GND in order to collect the toner from the intermediate roller 17. Subsequently, the bias VbA is again switched from GND to −700 V with the result that a toner layer is formed on the roller 17 due to the electrostatic force acting between the rollers 14 and 17 and the mechanical force. Thereafter, the bias VbA is switched from −700 V to GND in order to form a toner layer in a part of the roller 17. When the toner layer arrives at the nip Q between the roller 17 and the drum 1, the rotation of the drum 1 is stopped. The MPU 22 controls the switch 20 in such a manner as to execute the above control.

The switching time of the bias VbA is controlled such that the toner layer formed in a part of the roller 17 has a greater width than the nip between the roller 17 and the drum 1. The period of time of the last toner collection is selected to be long enough for the toner layer formed on the roller 17 at the point P to reach the nip Q.

With this embodiment, it is possible to form a toner layer on the roller 17 at least at the nip Q between the roller 17 and the drum 1 and to thereby save the toner. Further, the embodiment allows a minimum of toner to become unstable due to discharge, compared to the case wherein the apparatus is left unused over a long period of time with the toner existing on the entire periphery of the roller 17. This obviates the fly-about of the toner and other troubles.

In the illustrative embodiment, the procedure for forming a toner layer on the roller 17 begins just after the procedure for collecting the toner from the roller 17. Alternatively, a certain interval may be provided between the two procedures, if desired.

When the toner is collected from the intermediate roller 17, the toner charged to the opposite or irregular polarity is transferred from the roller 17 to the drum 1. So long as the image transfer unit or roller 5 located downstream of the developing unit 4 in the direction of rotation of the drum 1 is of noncontact type, the toner of opposite polarity will be successfully collected by the cleaning unit 8. However, if the image transfer unit 5 is of contact type, it is apt to collect the toner and then transfer it to the rear of the sheet 10.

Figure 7:
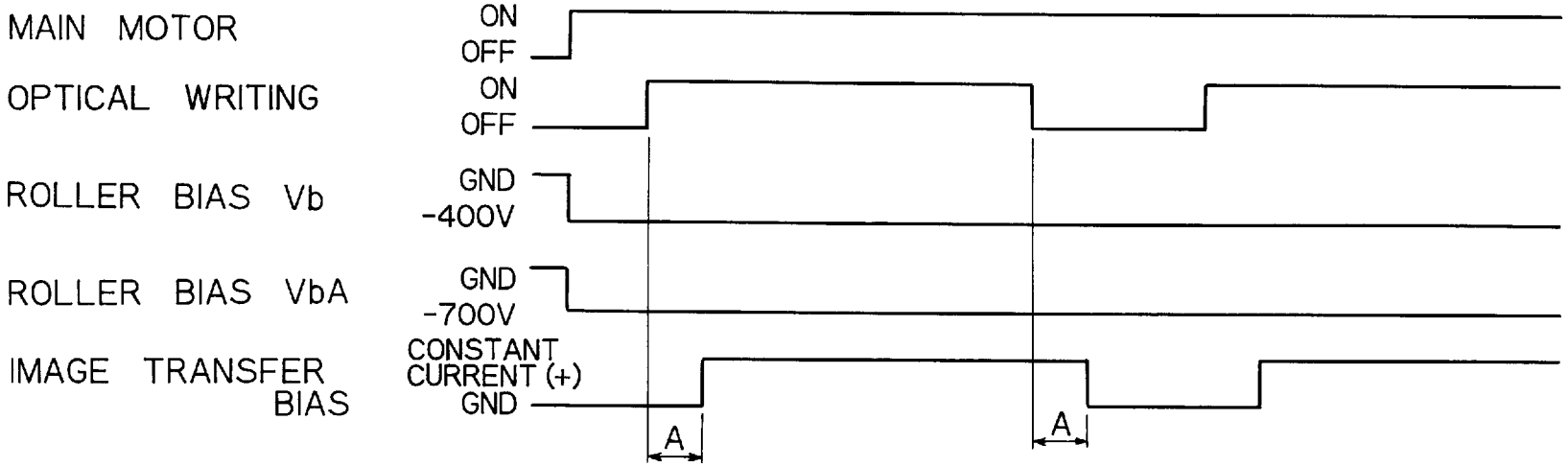
Fig. 7 PRIOR ART
FIG. 7 is a timing chart demonstrating conventional bias control to be executed by an electrophotographic recording apparatus including an image transfer unit implemented as a roller.

FIG. 7 is representative of conventional bias control executed by the electrophotographic recording apparatus including the image transfer roller. As shown, just before the main motor 21 is energized, biases are applied to the intermediate roller 17 and developing roller 14. After the sheet 10 has begun to be picked up, the writing device starts writing a latent image on the drum 1. At the position Q, FIG. 2, where the roller 17 contacts the drum 1, the toner is fed to the latent image in order to transform it to a toner image. On the elapse of a period of time A as counted from the time when the latent image has been formed at the position S, FIG. 2, the toner image arrives at the image transfer position R. Assuming that the arc SR has a length p, and that the drum 1 moves at a linear velocity v, then the above period of time A is expressed as A=p/v. On the elapse of the period of time A, the transfer of the toner image from the drum 1 to the sheet 10 begins.

Figure 8:
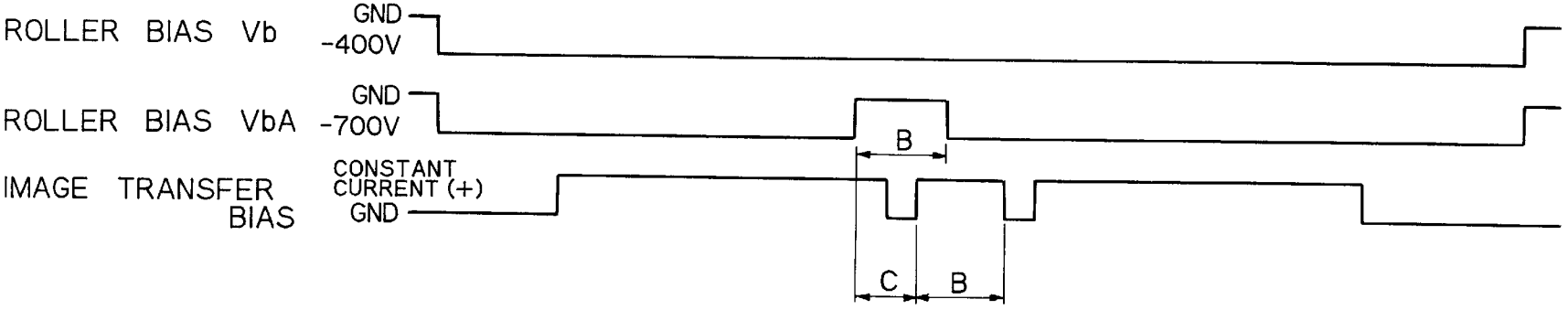
FIG. 8 is a timing chart demonstrating bias control for collecting toner from an intermediate roller by a developing roller.

FIG. 8 shows bias control for collecting the toner from the roller 17 by the roller 14, and bias control for the image transfer roller 5 and associated with the above bias control. As shown, to collect the toner form the roller 17, the bias VbA assigned to the roller 14 is switched from −700 V to GND for a period of time B. A period of time C is necessary for the toner transferred from the roller 14 to the roller 17 to reach the image transfer position R where the image transfer roller 5 and drum 1 contact. In this manner, the bias VbA is restored to the usual voltage when the period of time C expires after the start of the toner collecting operation.

Assume that the toner of opposite polarity is not collected from the roller 17 by the roller 14 and is transferred to the drum 1. In the above embodiment, the usual bias for image transfer is applied to the roller 5 only for the period of time B necessary for the toner of opposite polarity to move away from the position R; that is the polarity of the image transfer bias is the same as the the polarity of the charge of the toner deposited on the drum 1. As a result, the toner of opposite polarity and metallic soap are not transferred to the roller 5, but simply collected by the cleaning unit 8. This protects the rear of the sheet 10 from contamination.

If the bias for image transfer is applied to the image transfer roller 5 when the sheet 10 is absent at the position R, it adversely influences the drum 1. It is therefore preferable that the duration of the switching of the bias VbA and the duration of the application of the image transfer bias be equal to each other, i.e., B in order to minimize the duration of the image transfer bias when the sheet 10 is absent at the position R. However, the latter duration must be at least slightly longer than the former duration.

Figure 9:
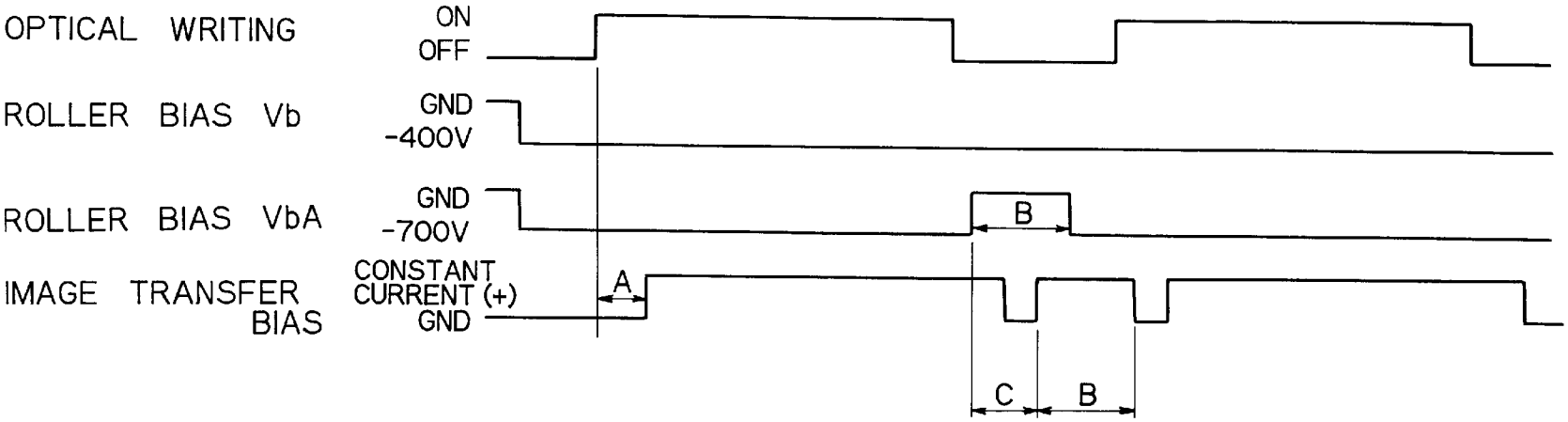
FIG. 9 is a timing chart demonstrating a bias control for the image transfer roller applied to the first embodiment.

FIG. 9 shows the control over the bias assigned to the image transfer unit or roller 5 which is applied to the first embodiment. As shown in FIGS. 2 and 9, on the elapse of the period of time A after the first optical writing has started at the position S, the bias is applied to the roller 5 when the leading edge of the resulting latent image arrives at the image transfer position R. When the trailing edge of the latent image arrives at the position R, the bias applied to the roller 5 is switched to GND. Subsequently, when the point of the drum 1 corresponding to the point of the roller 17 where toner connection has begun reaches the position R, i.e., on the elapse of the period of time C after the switching of the bias VbA to GND, the bias of image transfer is applied to the roller 5. When the point of the drum 1 corresponding to the point of the roller 17 where toner collection has ended reaches the position R, i.e., on the elapse of the period of time B after the replacement of the usual bias, the bias applied to the roller 5 is restored to GND. Thereafter, when the leading edge of the latent image arrives at the position R, the bias for image transfer is applied to the roller 5.

By the above control, the toner of opposite polarity and existing on the drum 1 is not transferred to the roller 5, but simply collected by the cleaning unit 8.

Figure 10:
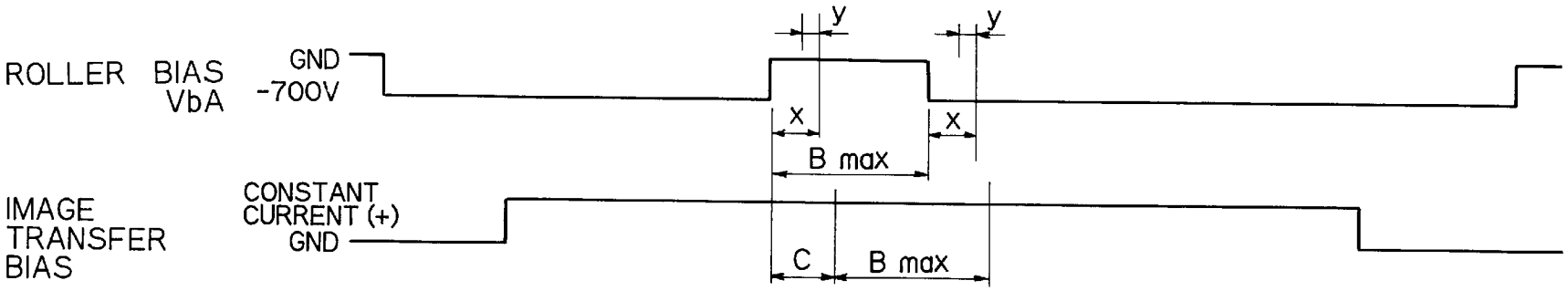
FIG. 10 is a timing chart indicative of the maximum duration of the ground or GND level of a bias assigned to the developing roller.

In this case, as shown in FIG. 10, the maximum duration of the GND level of the bias VbA is Bmax, i.e., the interval between the end of the optical writing of the first image and the beginning of the optical writing of the second image.

In FIG. 10, x is a period of time necessary for the toner deposited on the roller 17 at the position P to reach the nip Q between the roller 17 and the drum 1, while y is a period of time necessary for the latent image formed on the drum 1 a t the position S to reach the nip Q. The time for applying the bias VbA to the roller 14 is determined by the periods of time x and y which are expressed as:

$$x=q/v_{mid}$$

$$y=r/v$$

where q is the length of the arc PQ, $V_{mid}$ is the linear velocity of the intermediate roller 17, r is the length of the arc SQ, and v is the linear velocity of the drum 1.

Figure 13:
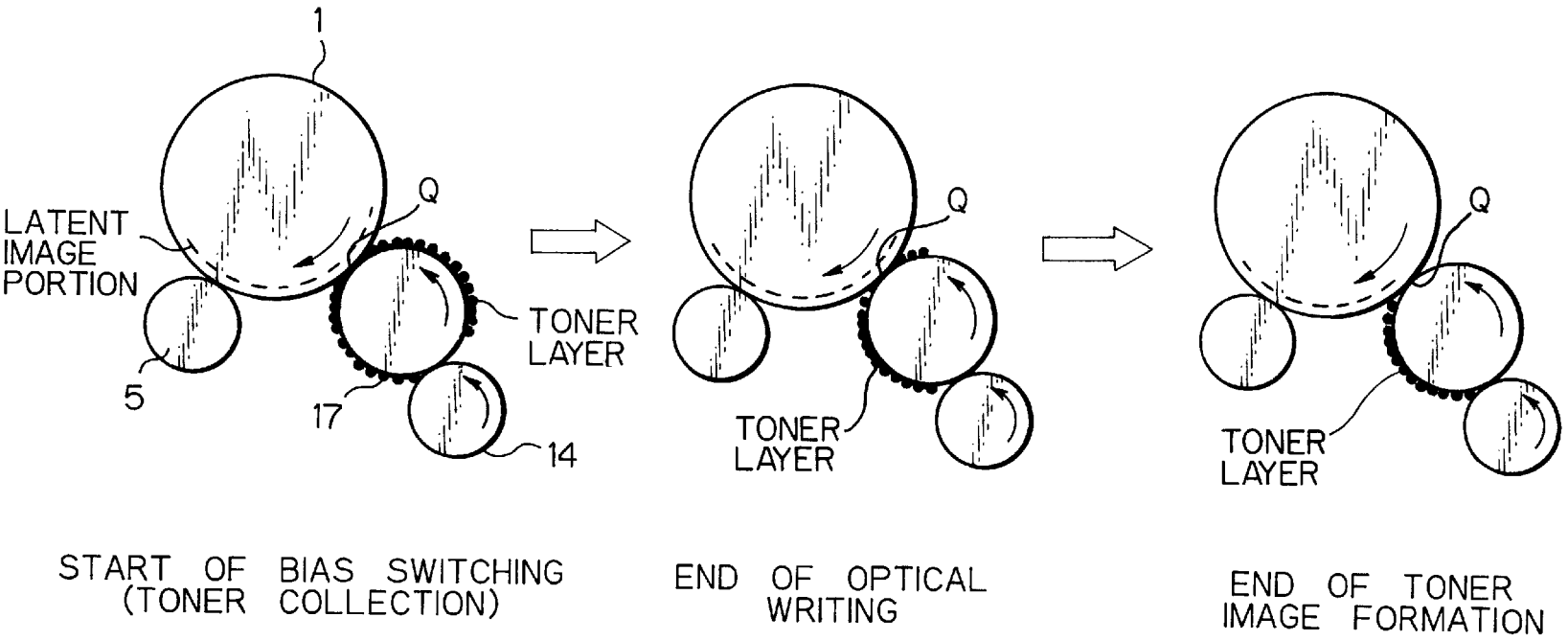
FIG. 13 shows how toner is collected.

Specifically, as shown in FIG. 13, if the bias VbA starts being switched x second before the trailing edge of the latent image formed on the drum 1 reaches the nip Q between the roller 17 and the drum 1, then the toner collection area of the roller 17 arrives at the nip Q just after the trailing edge of the latent image has moved away from the nip Q.

Figure 14:
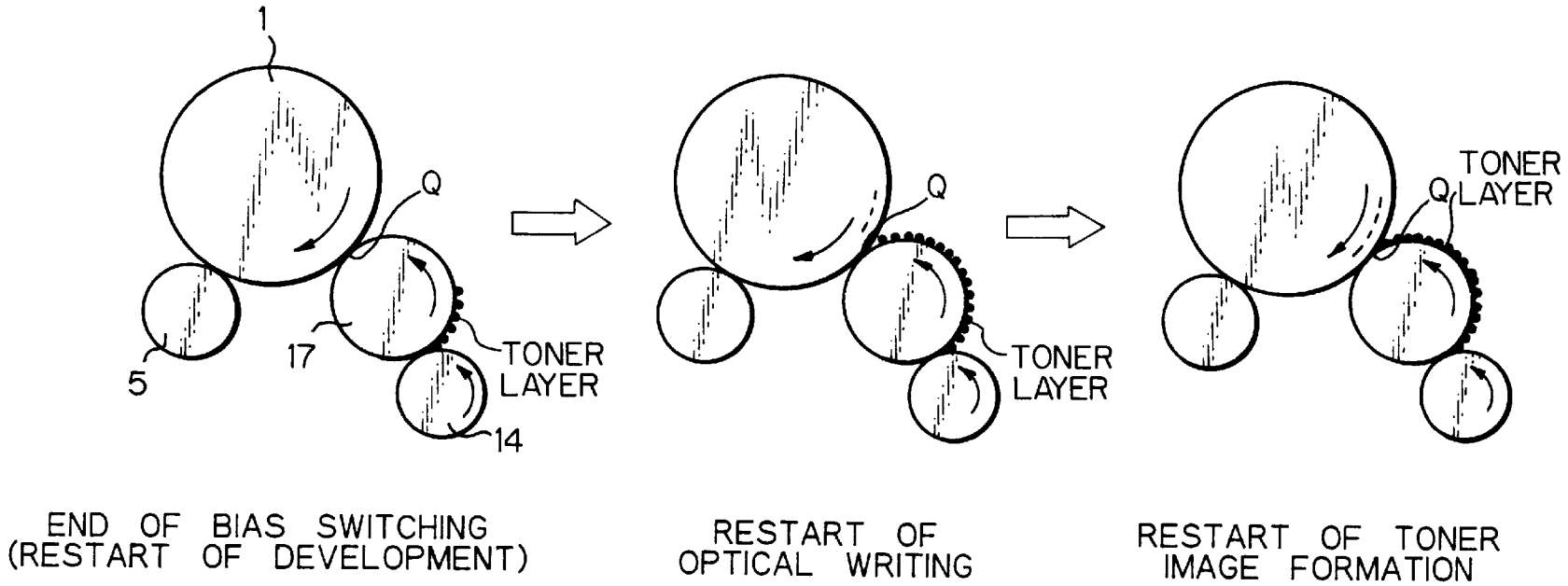
FIG. 14 shows how development is restarted.

This is also true with the end of the switching of the bias VbA. As shown in FIG. 14, if the switching of the bias VbA ends (i.e. if the toner deposition on the roller 17 begins) x second before the trailing edge of the latent image formed on the drum 1 reaches the nip Q, the area of the roller 17 from which the toner has been collected arrives at the nip Q just before the leading edge of the latent image moves away from the nip Q. This kind of control prevents the toner from being wastefully consumed.

Figure 11:
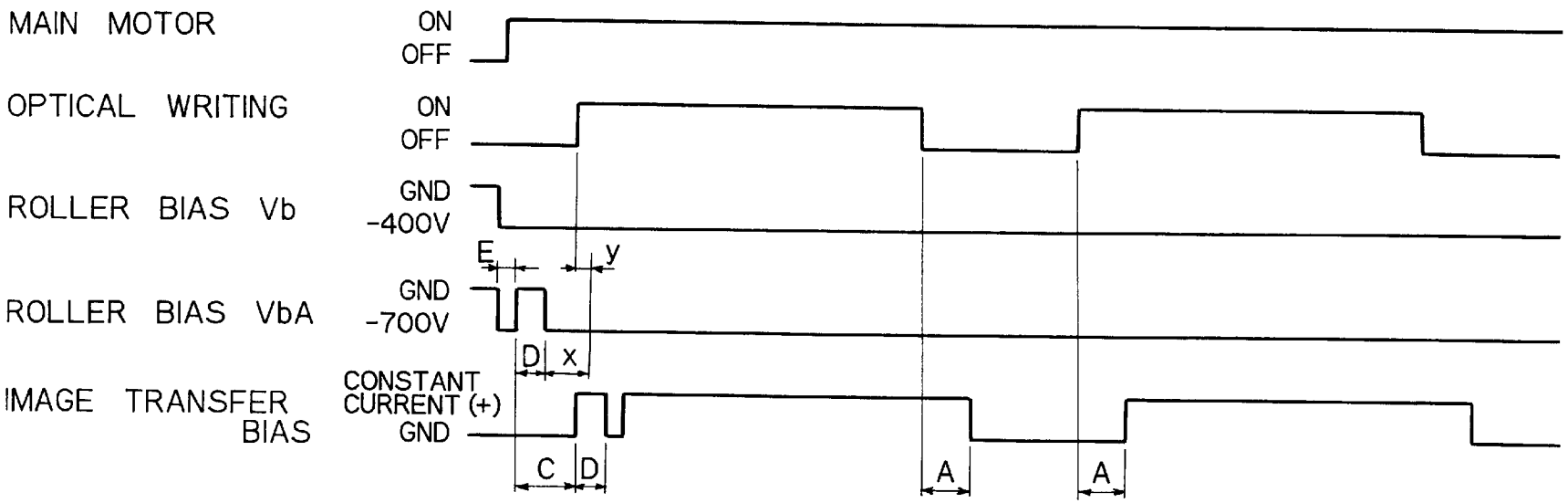
FIG. 11 is a timing chart representative of bias control for the image transfer roller applied to the second embodiment.

FIG. 11 shows control over the image transfer bias to be executed when the image transfer roller 5 included in the second embodiment is used. At the time when the main motor 21 starts rotating, it is preferable that the toner be present on the intermediate roller 17 in order to reduce the required torque. For this purpose, the biases VbA and Vb assigned to the rollers 14 and 17, respectively, begin to be switched just before the main motor 21 starts rotating. The rotation of the main motor 21 becomes stable in a period of time E after the start of rotation. When the rotation of the main motor 21 becomes stable, the bias VbA is switched to GND and is held at GND up to the start of development of the first sheet area of the drum 1. This period of time is labeled D in FIG. 11. Further, the bias for image transfer is applied to the image transfer roller 5 on the elapse of the period of time C after the switching of the bias VbA to GND.

As also shown in FIG. 11, the bias for image transfer is applied to the image transfer roller 5 on the elapse of the period of time C after the switching of the bias VbA. On the elapse of the period of time D, the bias VbA is switched to GND. Subsequently, on the elapse of the period of time C after the start of the optical writing, the bias for image transfer is applied to the unit 5.

The above control successfully reduces the torque at the time when the main motor 21 starts rotating. However, just after the start of rotation of the motor 21, the toner charged to the regular or negative polarity, but short of charge, is deposited on the roller 17 during the period of time E because the charge of the drum 1 and that of the toner are often insufficient. In the embodiment, just after the rotation of the motor 21 has been stabilized, but before the development of the latent image, the toner collection from the roller 17 and the control over the image transfer bias are executed. As a result, the toner existing on the roller 17 is collected and prevented from depositing on the defectively charged portion of the drum 1. In addition, the toner of opposite polarity and metallic soap remaining on the roller 17 are transferred to the drum 1 and then collected by the cleaning unit 8.

Figure 12:
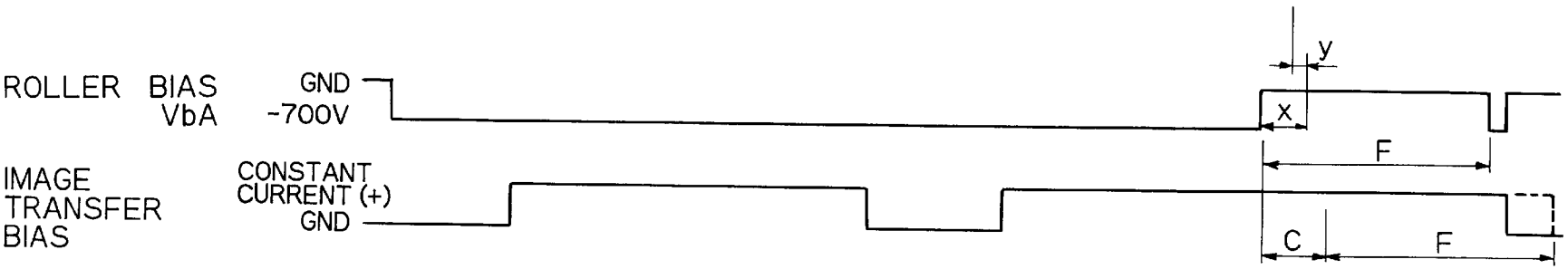
FIG. 12 is a timing chart representative of bias control for the image transfer roller applied to the third embodiment.

FIG. 12 shows control over the image transfer bias to be executed when use is made of the image transfer roller 5 included in the third embodiment. As shown, the bias VbA is switched only for a preselected period of time F during the interval between the end of the sheet area of the drum 1 and the stop of rotation of the drum 1 and rollers. In addition, as shown in FIG. 6, the bias for image transfer is applied to the roller 5 on the elapse of the period of time C after the switching of the bias VbA from −700 V to GND.

The earliest possible time for switching the bias VbA from −700 V to GND should be x second before the trailing edge of the latent image formed on the drum 1 arrives at the nip Q between the intermediate roller 17 and the drum 1. However, as shown in FIG. 12, if the time for applying the image transfer bias is coincident with the time for switching the bias VbA, then the image transfer bias will be continuously applied even after the stop of rotation of the motor 21. In such a case, the image transfer bias should only be interrupted at the same time as the biases Vb and VbA.

By the above control, it is possible to obviate wasteful toner consumption during the interval between the end of development and the stop of operation of the apparatus. Moreover, because the toner charged to the opposite polarity is held in contact with the surface of the drum 1 brought to a stop, the load to act on the cleaning unit 8 at the beginning of the next rotation of the drum 1 is reduced.

In summary, it will be seen that the present invention provides a developing device for an electrophotographic recording apparatus having various unprecedented advantages, as enumerated below.

(1) The device obviates defective images ascribable to the adhesion of an image carrier and second toner conveying means, while eliminating background contamination and wasteful toner consumption.

(2) The device allows a minimum of toner to become unstable due to discharge, compared to the case wherein the apparatus is left unused over a long period of time with toner existing on the entire periphery of the second toner conveying means. This prevents the toner from flying about and obviates other various troubles.

(3) The device obviates background contamination, irregular image density and other defects just after the start of printing.

Various modifications will become possible for those skilled in the art after receiving the teachings of the present disclosure without departing from the scope thereof.

What is claimed is:

1. A developing device for an electrophotographic image recording apparatus, comprising:

first toner conveying means for conveying a single-component type toner deposited thereon;

second toner conveying means contacting said first toner conveying means and an image carrier for electrostatically forming a latent image thereon, and for conveying the toner transferred theretofrom said first toner conveying means and depositing said toner on said latent image to thereby produce a corresponding toner image; and control means for stopping a rotation of the image carrier when a toner layer is positioned at a nip between the image carrier and said second toner conveying means.

2. A device as claimed in claim 1, further comprising bias control means for switching, during development of an area of said image carrier other than a latent image area, at least one of a bias assigned to said first toner conveying means and a bias assigned to said second toner conveying means to thereby form an electric field different in direction from an electric field assigned to a formation of the toner image between said first toner conveying means and said second toner conveying means.

3. A device as claimed in claim 2, wherein a development of said area other than said latent image area includes at least one of a development following a printing of a last page and a development of an area between a plurality of sheets fed one after another.

4. A device as claimed in claim 2, wherein after the electric field between said first conveying means and said second conveying means has been changed in direction, but before a stop of rotation of the image carrier, said electric field is restored in direction for thereby forming a toner layer on said second toner conveying means.

5. A device as claimed in claim 4, wherein after the toner layer has been formed on said second toner conveying means, the electric field between said first toner conveying means and said second toner conveying means is again switched to the electric field different in direction from the electric field assigned to a formation of the toner image.

6. A device as claimed in claim 1, wherein the toner layer has a width greater than a nip width between said first toner conveying means and said second toner conveying means.

7. A device as claimed in claim 1, wherein after a stop of rotation of the image carrier, but before a start of a new developing operation, at least one of a bias assigned to said first toner conveying means and a bias assigned to said second toner conveying means is switched to thereby form an electric field different in direction from an electric field assigned to a formation of the toner image between said first toner conveying means and said second toner conveying means.

* * * * *